United States Patent [19]

Quiogue

[11] Patent Number: 4,931,914

[45] Date of Patent: Jun. 5, 1990

[54] BALLAST AND OPTICAL HOUSINGS FOR GRADE MOUNTED LIGHT FIXTURE

[75] Inventor: Honesto D. Quiogue, Florence, Ky.

[73] Assignee: Hubbell Incorporated, Orange, Conn.

[21] Appl. No.: 327,547

[22] Filed: Mar. 23, 1989

[51] Int. Cl.[5] ..... F21V 23/00

[52] U.S. Cl. ..... 362/265; 362/153.1; 362/222; 362/362; 362/375

[58] Field of Search ..... 362/153.1, 221, 222, 362/265, 362, 364, 375, 260

[56] References Cited

U.S. PATENT DOCUMENTS

| | | | |
|---|---|---|---|
| 2,038,506 | 4/1936 | Cadieux | 362/153 |
| 2,631,247 | 3/1953 | Shaw | 362/276 |
| 3,264,466 | 8/1966 | Bacon, Jr. | 362/362 X |
| 3,274,392 | 9/1966 | Harling | 250/239 |
| 3,543,099 | 11/1970 | Turner | 250/226 |
| 3,880,528 | 4/1975 | Petersen et al. | 250/239 |
| 4,207,464 | 6/1980 | Fukuyama et al. | 250/239 |
| 4,220,986 | 9/1980 | Matteo et al. | 362/375 X |
| 4,343,032 | 8/1982 | Schwartz | 362/802 |
| 4,382,274 | 5/1983 | De Backer | 362/193 |
| 4,399,497 | 8/1983 | Druffel | 362/362 |
| 4,642,742 | 2/1987 | de Vos et al. | 362/375 |
| 4,791,290 | 12/1988 | Noone | 250/214 AL |

OTHER PUBLICATIONS

Imperial Bronzelite Brochure, Advanced Grade--Mounted Landscape Lighting, pp. 4–16, 1987.

*Primary Examiner*—Stephen F. Husar

*Attorney, Agent, or Firm*—Jerry M. Presson; Mark S. Bicks; Alfred N. Goodman

[57] ABSTRACT

A light fixture includes separate ballast and optical housings. The optical housing includes an open top, a hollow base depending from the open top and a wiring chamber extending laterally from the hollow base adjacent to the open top. A cover is releasably coupled to the housing, extends over the open top, and has an aperture extending through it receiving a lens. The lamp is mounted in the base of the optical housing for directing light through the lens. The ballast housing is releasably coupled to the optical housing at the wiring chamber. A ballast cover is coupled to the ballast housing. An electrical ballast assembly is mounted in the ballast housing. Wiring extends between the housings for electrically connecting the lamp and the electrical ballast assembly.

15 Claims, 4 Drawing Sheets

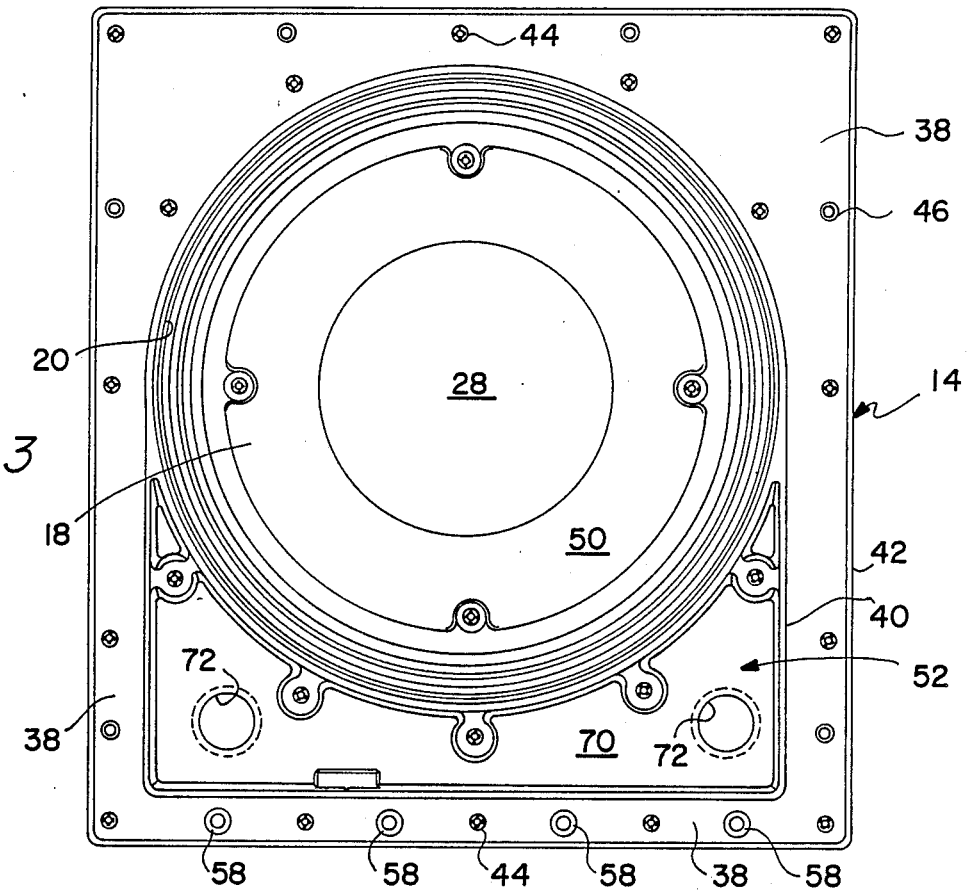
FIG. 3
FIG. 4
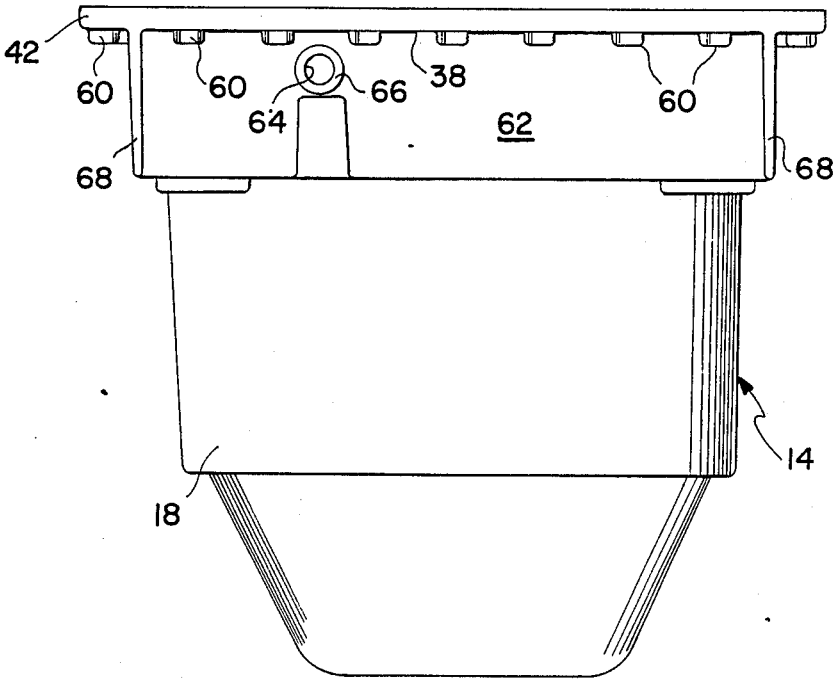

BALLAST AND OPTICAL HOUSINGS FOR GRADE MOUNTED LIGHT FIXTURE

FIELD OF THE INVENTION

The present invention relates to separate ballast and optical housings for a grade-mounted outdoor light fixture which can use various incandescent, low voltage and high intensity discharge lamps. The optical and ballast housings are releasably coupled such that the optical housing can be used without the ballast housing when the light fixture lamp does not require any ballast or transformer. However, the ballast housing can be easily attached to the optical housing when the lamp requires a ballast or transformer.

BACKGROUND OF THE INVENTION

Grade-mounted light fixtures perform a variety of desirable functions, such as illuminating buildings, flag poles, trees, shrubs and sign boards. Such lighting fixtures are grade-mounted because the fixtures are installed in recesses in landscape adjacent to the structure to be illuminated such that the uppermost surface of the light fixture is substantially flush or coplanar with the landscape surface.

Light fixtures installed in recesses in the landscape require special consideration in design and construction. Depending on the type of lamp used in the fixture, a ballast or transformer may be required. If a ballast or transformer is required, adequate room must be provided in the fixture for such electrical devices.

A typical incandescent lamp, similar to a ordinary house bulb, operates without a ballast or transformer. Lamps classified as low voltage will operate only with a transformer. High intensity discharge lamps require a ballast to operate properly. A typical ballast includes a core and coil, a starter and a capacitor for proper functioning of the high intensity discharge lamp. Such ballast occupies a relatively large volume. Additionally, such ballast should operate at a temperature cooler than or below its thermal rating for UL certification and for a maximum longevity. For operation of these electrical devices at cooler temperatures, it is often necessary to isolate the electrical devices from the heat produced by the lamp.

Known fixtures combine optical and ballast housings. Such integrally combined housings are disadvantages. When the lamp does not require a transformer or ballast, the fixture uses extra material resulting in excess weight and volume, and is more expensive. The known fixture housings cannot be easily adapted for the requirements of the lamp.

SUMMARY OF THE INVENTION

An object of the present invention is to provide a light fixture comprising easily separable ballast and optical housings such that the ballast housing is attached to the optical housing when the lamp used in the light fixture requires a transformer or ballast.

Another object of the present invention is to provide a light fixture having a removable ballast housing which provides an effective means for passing electrical wires between the ballast and optical housings.

The forgoing objects are obtained by a light fixture comprising an optical housing and a ballast housing releasably coupled to the optical housing. The optical housing includes an open top, a hollow base depending from the open top and a wiring chamber extending laterally from the base adjacent the open top. An optical cover is coupled to the optical housing over the open top, and has an aperture extending through it. A light transparent lens is mounted in the cover aperture. A lamp is mounted in the optical housing base for directing light through the lens. The ballast housing is releasably coupled at the wiring chamber. An electrical ballast assembly is mounted in the ballast housing. Wiring means extends between the housings and electrically connects the lamp and the electrical ballast assembly.

By forming the light fixture in this manner, a single, efficient optical housing can be manufactured for use with any type of lamp. If the light fixture is used with an incandescent lamp, not requiring a ballast assembly, then the optical housing is used alone. However, if a low voltage lamp requiring a transformer or a high intensity discharge lamp requiring a ballast is used in the light fixture, then the ballast housing can be easily coupled to the same optical housing. In this manner, the amount material used and volume consumed by the light fixture is minimized to the greatest extent possible for each lamp. Moreover, the ballast assembly is separated from the lamp so that the lamp does not heat the ballast assembly.

As used in this application, "ballast assembly" broadly includes any electrical device used to assist or facilitate the operation of a lamp. It specifically includes a transformer or a ballast comprising the combination of a core and coil, a starter and a capacitor.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this original disclosure:

FIG. 3 is a top plan view of the optical housing of the light fixture of FIG. 1;

FIG. 4 is a side elevational view of the optical housing of FIG. 3;

DETAILED DESCRIPTION OF PREFERRED EMBODIMENT

Figure 2:
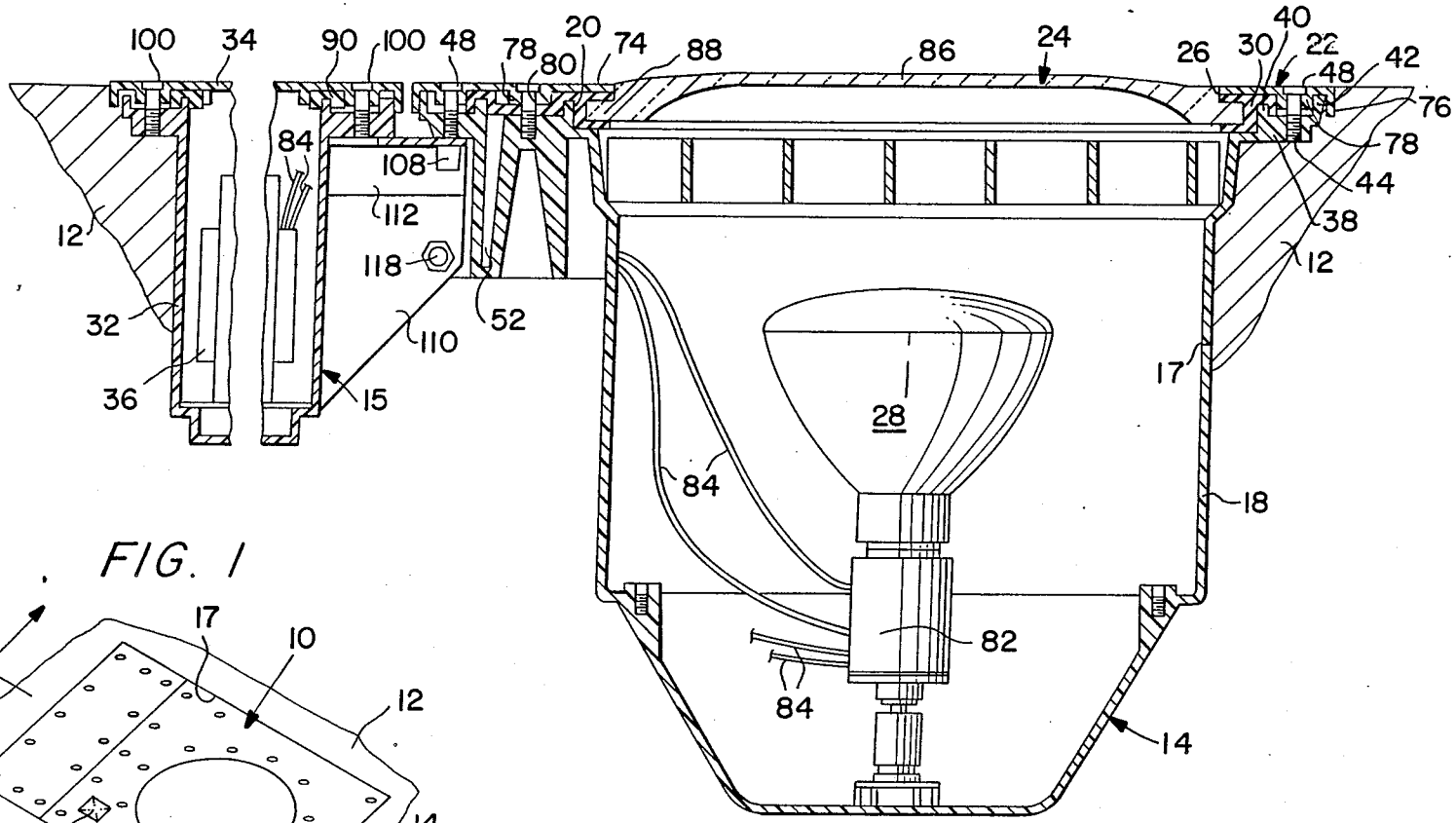
FIG. 2 is a side elevational view in section of the light fixture, taken along lines 2—2 of FIG. 1.
Figure 1:
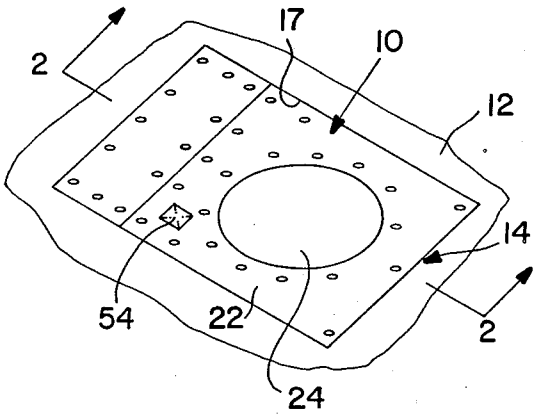
FIG. 1 is a perspective view of a light fixture according to the present invention.
Figure 5:
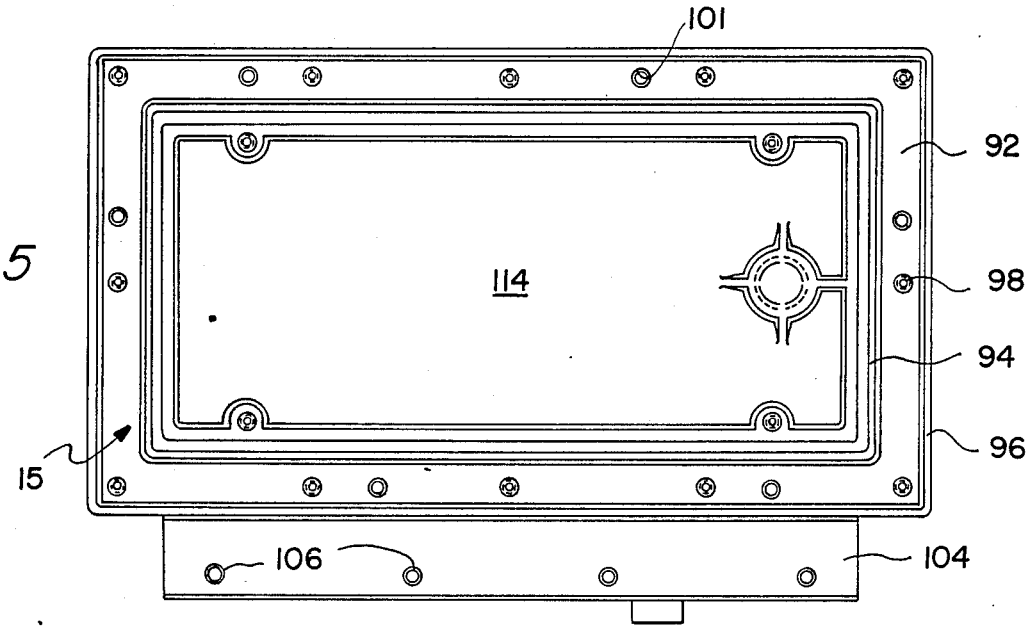
FIG. 5 is a top plan view of the ballast housing of the light fixture of FIG. 1.
Figure 6:
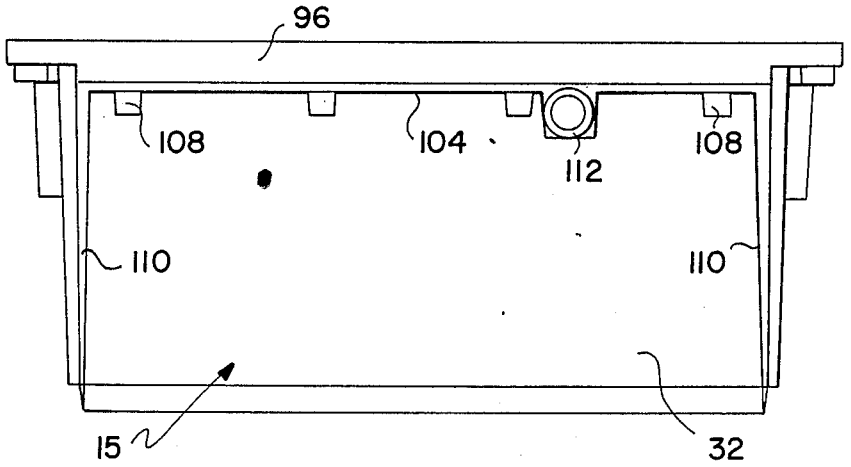
FIG. 6 is a side elevational view of the ballast housing of FIG. 5.

Referring initially to FIGS. 1 and 2, the light fixture 10 of the present invention is mounted in a recess 17 formed in a graded landscape environment 12. Light fixture 10 comprises a lamp or optical housing 14 and a ballast housing 15 removably coupled to the optical housing.

Optical housing 14 comprises a unitary hollow base 18 having an open top 20 from the which the base depends. The base is typically made from molded plastic.

A removable optical cover 22 is coupled to optical housing 14, and has light transparent lens 24 mounted in an aperture 26 extending through the cover. A lamp 28 is mounted within the interior of optical housing 14. A gasket 30 is mounted between and seals the joints between the lens, the optical cover and the optical housing.

Ballast housing 15 comprises ballast base 32 and a ballast cover 34. Base 32 and cover 34 enclose a light fixture ballast assembly 36.

Referring to FIGS. 3 and 4, along with FIG. 2, optical housing 14 comprises a horizontal flange 38 extending laterally outwardly from the optical housing base about the entire periphery at open top 20. An inner upright wall 40 and an outer upright wall 42 extend upwardly from horizontal flange 38. Upright walls 40 and 42 are generally concentric, i.e., generally have a common center. Outer upright wall 42 is generally rectangular in plan view about its entire periphery. Inner upright wall 40 is rectangular in plan view in its lower half, is generally circular in plan view in its upper half, as illustrated in FIG. 3. Outer upright wall 42 is located generally at the remote or free end of flange 38, while inner upright wall 40 is spaced inwardly from outer upright wall 42 and defines the inner edge of flange 38. The inner and outer upright walls define a peripheral channel about the periphery of the optical housing horizontal flange 38.

Horizontal flange 38 includes internally threaded bores 44 and drain holes or opening 46 between upright walls 40 and 42. Threaded bores 44 receive fasteners 48 (FIG. 2) for securing optical cover 22 to optical housing 14. Drain openings or holes 46 drain any liquid contaminants passing inside of upright wall 42, but before such liquid contaminants can pass into the housing interior and damage the electrical components enclosed within the optical housing.

Inside of inner upright wall 40, the optical housing comprises a lamp compartment 50, defined by base 18, and an electrical component receiving compartment 52 on one side of the lamp compartment. The lamp compartment receives the lamp and underlies lens 24. Component receiving compartment 52 receives wiring and other electrical controls for the fixtures, such as a photocontrol device 54. An opening 56 is located within the housing to permit wiring to pass from compartment 50 to compartment 52 (see FIG. 7).

The portion of groove flange 38 adjacent wiring compartment 52 comprises four countersunk holes 58. These countersunk holes are spaced between adjacent threaded bores 44. Each of the countersunk holes 58 and threaded bores 44 are formed in projections 60 depending from flange 38.

A housing wall 62 forming an outer side of wiring compartment 52 comprises an opening 64. The opening is surrounded by a cylindrical projection 66. Opening 64 and cylindrical projection 66 mate with portions of ballast housing 15 to provide a wire passageway for the wiring electrically connecting lamp 28 and ballast assembly 36.

The optical housing comprises two reinforcing webs 68 which extend vertically and laterally outwardly from the optical housing base. Reinforcing webs 68 are located on opposite sides of aperture 64. Horizontal flange 38 and reinforcing webs 68 define three sides of a rectangle as viewed in FIG. 4. Vertical reinforcing webs 68 extend outwardly from housing wall 62 to an extent substantially equal to horizontal flange 38 and to an extent greater than annular projection 66. Additionally, the vertical reinforcing webs are spaced apart by a distance substantially equal to the longitudinal length of wiring chamber 52.

The base wall 70 defining the bottom of wiring chamber 52 as a plurality of openings 72. Openings 72 permit passing connecting and power lines to and from the light fixture.

As illustrated in FIG. 2, optical cover 22 comprises a generally planar top member 74 which extends over and laterally beyond open top 20. The center of the optical cover has an aperture 26 extending through it. About the entire periphery of top member 74, the cover has a depending peripheral flange 76. Peripheral flange 76 extends downwardly to a point below the uppermost edge of outer upright wall 42 and overlaps outer upright wall 42 of the optical housing.

Between peripheral flange 76 and aperture 26, the optical cover has a plurality of depending ribs. These ribs connect bosses 78 depending from the optical cover about bores 80 which receive fasteners 48. The ribs strengthen the cover and provide an alignment mechanism for gasket 30. The details of the gasket and cover rib arrangement, as well as the engagement thereof with the optical housing base, are disclosed in U.S. patent application Ser. No. 07/327,546, pending entitled Sealing System for Grade Mounted Light Fixture and filed on Mar. 23, 1989 in the name of Honesto D. Quiogue, the subject matter of which is hereby incorporated by reference.

Optical cover 22 also supports a photocontrol device 54 (FIG. 1). The photocontrol device is disclosed in U.S. patent application Ser. No. 176,318, entitled Photocontrol Device for Grade Mounted Light Fixture and filed Mar. 31, 1988 in the name of Honesto D. Quiogue, now U.S. Pat. No. 4,907,139 the subject matter of which is hereby incorporated by reference.

Lamp 28 can be any suitable lamp for emitting light through the lens. The lamp can be a typical incandescent lamp similar to that used as an ordinary house light bulb, which does not require any ballast or transformer. Alternatively the lamp can be of the low voltage type requiring the use of a transformer. Preferably, the lamp is a high intensity discharge lamp requiring a ballast to operate properly.

The lamp is mounted in a suitable socket 82 fixed within the optical housing interior. Socket 87 is electrically coupled to photocontrol device 54 and to ballast 36 by wires 84.

Lens 24 is generally in a shape of a circular disk having a raised center portion 86 and an annular peripheral flange 88. The flange is held in place and sealed about its periphery by gasket 30.

A gasket 90 is mounted between ballast base 32 and ballast cover 34. The details of this gasket, as well as its coupling to the ballast base and ballast cover are disclosed in the above-mentioned U.S. patent application Ser. No. 07/327,546, entitled Sealing System for Grade Mounted Light Fixture.

The upper portion of the ballast housing base 32, like the optical housing, comprises a horizontal flange 92 with an inner upright wall 94 and an outer upright wall 96. Between the inner and outer upright walls, horizontal flange 92 comprises a number of internally threaded bores 98 for receiving fasteners 100 (FIG. 2) securing ballast cover 34 to ballast housing base 32. Additionally, flange 92 comprises drain openings 101 for draining any liquid entering between upright walls 94 and 96.

A coupling flange 104 extends laterally outwardly from ballast housing base 32 adjacent one of the longer lateral sides of the ballast housing. The coupling flange is located generally parallel to but spaced below horizontal flange 92. Coupling flange 104 has four spaced, internally threaded bores 106. The spacing of bores 106 is equal to the spacing between countersunk holes 58 in optical housing horizontal flange 38. The coupling flange also has depending bosses 108 through which the threaded bores 106 extend.

Vertical reinforcing webs 110 are located at the opposite longitudinal ends of coupling flange 104. Webs 110 depend from coupling flange 104 and extend vertically for substantially the entire height of ballast housing base 32. Reinforcing webs 110 are spaced apart by a distance slightly less than the distance between vertical reinforcing webs 68 on optical housing 14, such that the outer surfaces of webs 110 are spaced apart by distance substantially equal to the inner surfaces of webs 68.

A generally cylindrical wiring conduit 112 extends laterally outwardly from ballast housing base 32 parallel to and below coupling flange 104. The wiring conduit is located adjacent flange 104. The transverse dimensions of wiring conduit 112 are substantially equal to the dimensions of opening 64 in cylindrical projection 66 on optical housing 14 such that the wiring conduit can be received within opening 64. The inner cavity or passageway of conduit 112 opens into the interior 114 of ballast housing 15.

Figure 7:
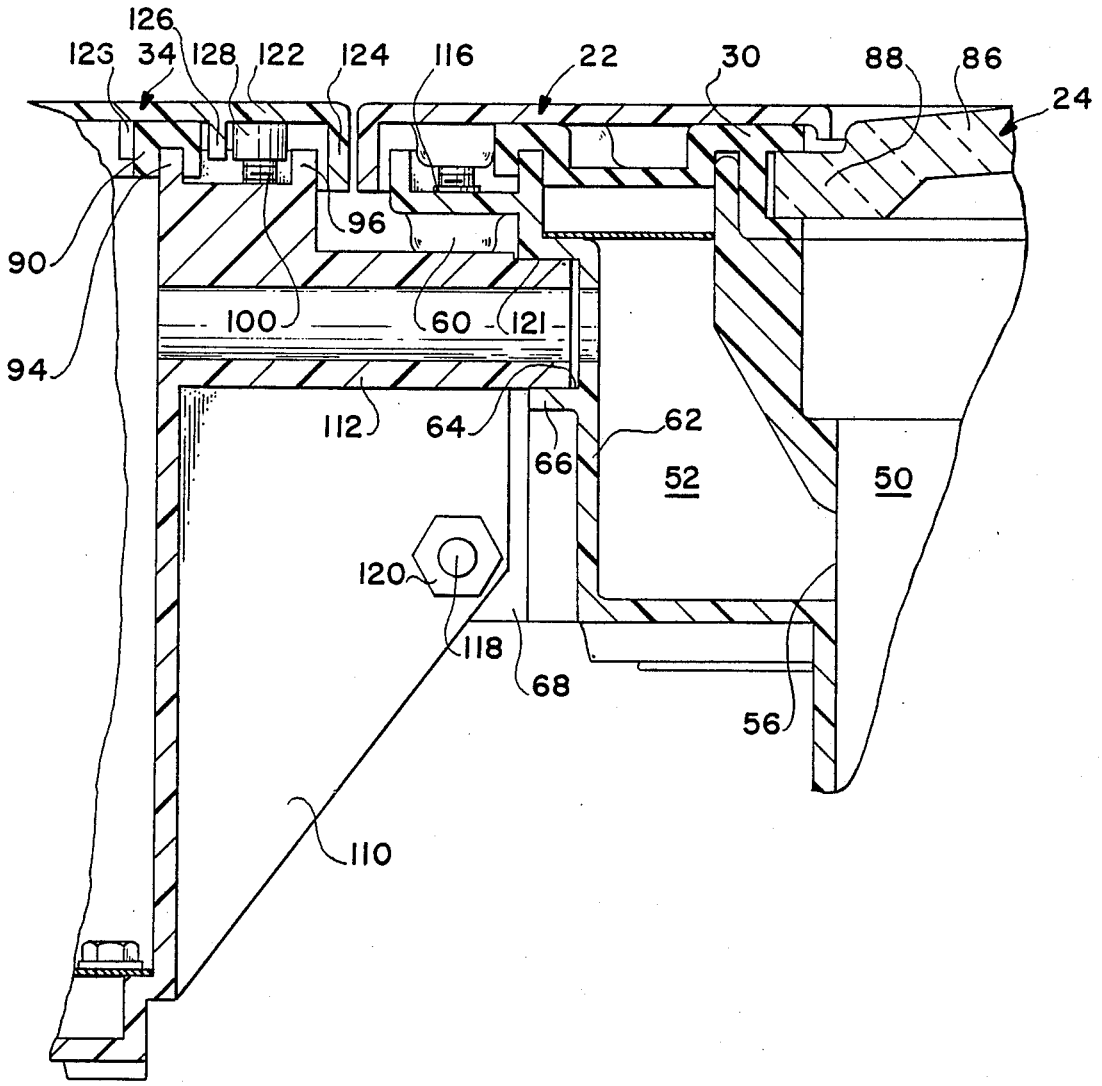
FIG. 7 is an enlarged, partial side elevational view in section of the light fixture of FIG. 1.

The details of the coupling of the optical housing to the ballast housing, particularly of the coupling of wiring conduit 112 to annular projection 66, is best illustrated in FIG. 7. Ballast housing base 32 is coupled to optical housing 14 by overlapping optical housing horizontal flange 38 with coupling flange 104. The coupling flange 104 underlies the portion of optical housing flange 38 adjacent wiring chamber 52. Countersunk holes 58 are aligned with threaded bores 106 such that threaded fasteners 116 can pass through flange 38 and be threadedly engaged within bores 106 to securely couple the optical and ballast housings. The spacing of coupling flange 104 below the ballast housing horizontal flange 92 locates the upper portions of the two housings at substantially the same plane. In the manner, the optical cover 22 and the ballast cover 34 will be generally coplanar in the assembled light fixture.

At the opposite ends of horizontal flange 38 and coupling flange 104, the respective reinforcing webs overlap. Threaded bolts or fasteners 118 secured in place by nuts 120 extend through aligned openings in the reinforcing webs. The reinforcing webs secured by bolts or fasteners 118 make the joint between the optical and ballast housings structurally ridged without the use of additional brackets. Specifically, the reinforcing webs with bolts or fasteners 118 withstand bending forces which may be placed on horizontal flange 38 of the optical housing and coupling flange 104 of the ballast housing.

Wiring conduit 112 has a distal or free end thereof received within opening 64 of cylindrical projection 66. Epoxy 121 can by applied around the joint between projection 66 and conduit 112 to seal the joint against entry of such contaminents as water. The interior of conduit 112 and opening 64 provide a wiring passageway for wires extending between the ballast and optical housings.

Ballast cover 34 comprises a top member 122 and a depending peripheral flange 124. Peripheral flange 124 extends downwardly to a point below the uppermost edge of outer upright wall 96 of ballast housing base 32 and overlaps outer upright wall 96.

Inside of peripheral flange 124, ballast cover 34 comprises a plurality of depending ribs 126. Depending ribs 126 connect bosses 128 depending from ballast cover 34 about bores receiving fasteners 100 securing the ballast cover to the ballast base. The ribs define a channel receiving the ballast housing gasket 90.

If the lamp used within the fixture does not require a ballast or a transformer, then the optical housing is used without a ballast housing. If the lamp used within the light fixture requires a ballast or transformer, then the ballast housing is attached and used with the optical housing as a single unit as described above.

Figure 8:
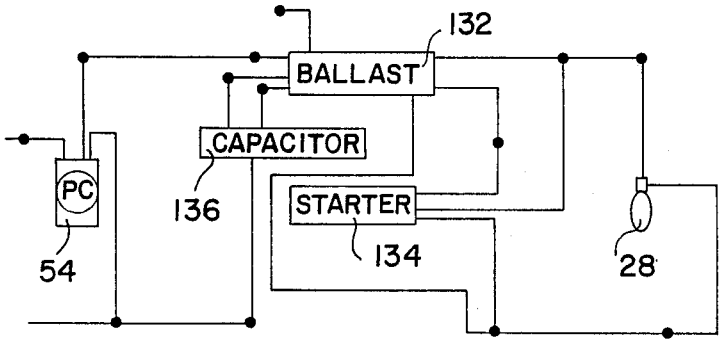
FIG. 8 is a systematic diagram of a typical ballast assembly for the light fixture of FIG. 1.

FIG. 8 illustrates a typical wiring diagram for light fixture having a photocontrol device 54 and a ballast for a 70 or 100 watt high intensity discharge lamp 28. The ballast assembly 36 comprises a ballast 132, a starter 134 and a capacitor 136. Other known ballast assembly circuits can be employed for the particular type and wattage of the lamp employed within the fixture.

While a particular embodiment has been chosen to illustrate the invention, it will be understood by those skilled in the art that various changes and modifications can be made therein without departing from the scope of the invention as defined in the appended claims.

What is claimed is:

1. A light fixture, comprising:

an optical housing including an open top, a hollow base depending from said open top and a wiring chamber extending laterally from said base adjacent said open top;

an optical cover coupled to said optical housing over said open top, said cover having an aperture extending therethrough;

a light transparent lens mounted in said aperture;

a lamp mounted in said base of said optical housing for directing light through said lens;

a ballast housing releasably coupled to said optical housing at said wiring chamber;

a ballast cover coupled to said ballast housing;

an electrical ballast assembly mounted in said ballast housing; and wiring means, extending between said housings, for electrically connecting said lamp and said electrical ballast assembly.

2. A light fixture according to claim 1 wherein said optical housing comprises a unitary, molded base.

3. A light fixture according to claim 1 wherein said ballast housing comprises a unitary, molded base.

4. A light fixture according to claim 1 wherein said lamp is a high intensity discharge lamp.

5. A light fixture according to claim 1 wherein said optical housing comprises a horizontal flange extending laterally from said wiring chamber, said ballast housing being coupled to horizontal flange.

6. A light fixture according to claim 1 wherein said ballast housing comprises a horizontal flange extending laterally therefrom, said optical housing being coupled to said horizontal flange.

7. A light fixture according to claim 1 wherein said optical housing comprises a horizontal flange extending laterally outwardly from said wiring chamber; and said ballast housing comprises a horizontal flange extending laterally outwardly therefrom, said horizontal flanges having overlapping portions, threaded fasteners passing through said overlapping portions to connect said housings.

8. A light fixture according to claim 7 wherein each of said horizontal flanges has vertical reinforcing webs depending from opposite ends thereof, one of said webs depending from each of said horizontal flanges abutting one of said webs depending from the other of said horizontal flanges.

9. A light fixture according to claim 8 wherein said webs depending from said optical housing horizontal flange are spaced apart by a greater distance than said webs depending from said ballast housing horizontal flange, said webs depending from said ballast housing horizontal flange being located between said webs depending from said optical housing horizontal flange.

10. A light fixture according to claim 8 wherein fasteners extend through and couple said webs.

11. A light fixture according to claim 1 wherein said optical housing comprises a side wall defining a side of said wiring chamber and having a bore extending therethrough; and said ballast housing comprises a wiring passageway extending laterally toward said optical housing and coupling said bore to said ballast housing.

12. A light fixture according to claim 11 wherein said wiring passageway comprises a generally cylindrical conduit having one end thereof secured in said bore.

13. A light fixture according to claim 12 wherein said end of said cylindrical conduit is secured in said bore by epoxy.

14. A light fixture according to claim 12 wherein said cylindrical conduit comprises a unitary portion of said ballast housing.

15. A light fixture, comprising:

a unitary optical housing including an open top, a hollow base depending from said open top, a wiring chamber extending laterally from said base adjacent said open top, a bore extending through said base into said wiring chamber and a first horizontal flange extending laterally outwardly from said wiring chamber, said first horizontal flange having vertical reinforcing webs depending from opposite ends thereof;

an optical cover coupled to said optical housing over said open top and having an aperture extending therethrough;

a light transparent lens mounted in said aperture;

a lamp mounted in said base of said optical housing for directing light through said lens;

a unitary ballast housing having a second horizontal flange extending laterally therefrom and a generally cylindrical wiring conduit extending laterally from said ballast housing adjacent said second horizontal flange, said horizontal flanges having overlapping portions with threaded fasteners passing through said overlapping portions to connect said housings, said second horizontal flange having vertical reinforcing webs depending from opposite ends thereof and received between said reinforcing webs of said optical housing, one end of said wiring conduit being received in said bore;

fasteners extending through and coupling said reinforcing webs;

a ballast cover coupled to said ballast housing;

a electrical ballast assembly mounted in said ballast housing; and wiring means, extending between said housings and through said bore and said wiring conduit, for electrically connecting said lamp and said electrical ballast assembly.

* * * * *